US005291108A

United States Patent [19]

Gerretz et al.

[11] Patent Number: 5,291,108

[45] Date of Patent: Mar. 1, 1994

[54] METHOD OF EQUALIZING THE TORQUE ON A DRIVE OF A PILGER ROLLING MILL

[75] Inventors: Josef Gerretz, Viersen; Michael Baensch; Klaus Rehag, both of Mönchengladbach, all of Fed. Rep. of Germany

[73] Assignee: Mannesmann Aktiengesellschaft, Dusseldorf, Fed. Rep. of Germany

[21] Appl. No.: 883,089

[22] Filed: May 15, 1992

[30] Foreign Application Priority Data

May 15, 1991 [DE] Fed. Rep. of Germany ..... 4116307

[51] Int. Cl.[5] ..... B21B 21/00; B21B 37/00

[52] U.S. Cl. ..... 318/433; 388/930; 72/21

[58] Field of Search ..... 318/567, 569, 600, 615, 318/638, 652, 671, 3, 254, 432, 433; 388/907.5, 930; 74/589, 590, 603; 72/21, 208, 214, 249, 250

[56] References Cited

U.S. PATENT DOCUMENTS

| | | | |
|---|---|---|---|
| 3,733,866 | 5/1973 | Arimura et al. | 72/6 |
| 4,037,444 | 7/1977 | Ledebur et al. | 72/21 |
| 4,052,898 | 10/1977 | Miller et al. | 72/214 |
| 4,386,512 | 6/1983 | Rehag et al. | 72/214 |
| 4,478,119 | 10/1984 | Larson | 318/603 X |
| 4,562,713 | 1/1986 | Kondoh | 72/214 X |
| 4,578,626 | 3/1986 | Richter . | |
| 4,814,678 | 3/1989 | Omae et al. | 318/434 |
| 4,858,458 | 8/1989 | Gerretz et al. | 72/214 |
| 5,070,287 | 12/1991 | Boehm | 11/569 |
| 5,076,088 | 12/1991 | Klingen et al. | 72/214 |

*Primary Examiner*—Bentsu Ro

*Attorney, Agent, or Firm*—Pontani, Lieberman, Pavane Cohen

[57] ABSTRACT

A method and apparatus for torque equalization on the drive of a rolling stand, having a linear oscillatory movement driven via a crank drive, of a Pilger step-by-step rolling mill, particularly a cold Pilger rolling mill. In order to avoid the inefficient and/or expensive drive and to create a torque equalization system which avoids generator operation of the motor of the drive device of the mill and therefore torques acting in the direction of rotation of the motor on the motor, the variation of speed of rotation of the crank drive, determined mathematically from the kinematic parameters of the system, the masses moved and the external loads, is imparted to the crank drive as a desired variation of speed of rotation.

9 Claims, 3 Drawing Sheets

METHOD OF EQUALIZING THE TORQUE ON A DRIVE OF A PILGER ROLLING MILL

FIELD OF THE INVENTION

The present invention relates to a method of equalizing the torque on the drive of a roll stand which is moved linearly back and forth by a crank drive, particularly of a Pilger step-by-step rolling mill, and more particularly of a cold Pilger rolling mill.

BACKGROUND OF THE INVENTION

The oscillating movement of the roll stand of a pilger step-by-step rolling mill has the result that the kinetic energy in the roll stand varies greatly over the path. Without suitable countermeasures, the crank drive would attempt to outspeed the motor twice per oscillation period and therefore cause the motor to act as a generator. The periodic change from motor mode operation to generator mode operation arising therefrom results in increased wear of the motor and furthermore increases the energy consumption of the rolling mill. The energy which the motor takes from the crank drive during generator mode operation must be returned to the crank drive during the following motor mode operation.

Thus, it is apparent that, if the motor drive supplies a constant power, equal to the time average power necessary for the operation of the device, that there will be a degree of inefficiency resulting from the time varying course of the power requirements within the operation cycle of the machine. While devices as large flywheels or other mechanical rotation power storage devices do exist which might reduce angular velocity variations, their use poses significant disadvantages due to their size constraints, as well as their adverse effect on startup and shutdown of a mill. In addition, these constant angular momentum devices do not allow the normal variations in crank angular velocity.

However, since the electrical energy produced during generator mode operation cannot be utilized during motor mode operation, this portion of the energy may be seen, to the operator of the rolling mill, as an apparent power which is wasted and unnecessarily increases operating expenses.

To avoid the periodic change from generator to motor operation, two different types of drive constructions have been used. Thus, German Patent No. DE 10 84 451, expressly incorporated herein by reference, proposes to supplement the crank drive device, producing the movement of the roll stand, with a similar crank drive operated 90° out of phase, i.e. in quadrature relationship. In this way, a continuous exchange of kinetic energy can take place between the two crank drives. This method has the advantage that the crank speeds of rotation and the crank moment, as well as the corresponding motor speed of rotation and motor moment, are approximately constant over an operating cycle, but it has the disadvantage that the expense for the construction of the machine is greatly increased. The required space is also increased, since, in general, deep foundations are necessary for the components. Finally, inertia forces having a higher order, which can only be compensated for with difficulty, result from operation according to this method.

Another method of solving the problem of the biphasic operation includes the use of torque balancing by the interposition of transmissions having non-uniform, i.e. varying drive ratios. In the normal case, if a crank drive which moves a roll stand is accelerated to a given speed of rotation and then disconnected from the drive, the speed of rotation of the crank shaft will thereafter change periodically. If there is no friction present, this will be true for very long periods of time. If a transmission having a nonuniform ratio corresponding to the natural periodic variation of the crank shaft, i.e., for a constant drive speed of rotation the transmission, has exactly the same variation of speed of rotation on the driven side which the crank drive would have in a non-driven condition, is inserted between the drive and the crank shaft, then the crank drive can also be driven with a constant motor speed of rotation and a constant motor moment. In such a case, the intermediate transmission must convert a constant speed of rotation into a variable speed of rotation which corresponds to the free variation of the speed of rotation of the crank drive. Since the variations in speed of rotation of the crank drive are dependent on the specific speed of rotation, the transmission behavior of the intermediate transmission also must be variable.

One intermediate transmission which is actually used for the equalizing of torque is the so-called cardan joint, which can be adapted to the variations in speed of rotation by changing the angle of bend in the joint, as known from German Patent No. DE 20 30 995, expressly incorporated herein by reference. The method of DE 20 30 995 has the disadvantage that the structural expense necessary in order to make it possible to adjust the torque equalization to a given speed of rotation, is very high. In addition, when the system is not operating at steady state, such as when the operating speed of rotation is changed (decreased), the motor will enter into a generator mode of operation, unless the equalization of the torque is automatically effected. Furthermore, the influence of the load on the torque equalization cannot be taken into account. Therefore, a system, such as that proposed in DE 20 30 995, with a predetermined variation in the transmission ratio, will not be suitable under all conditions of operation.

SUMMARY AND OBJECTS OF THE INVENTION

It is therefore an object of the present invention, starting from the above-described prior art and the disadvantages described, to create a torque equalization system which avoids generator mode operation of the motor of the drive device, and therefore torques acting on the motor in the direction of rotation of the motor, in a reliable manner and at low manufacturing expense.

In order to achieve the aforementioned object, the present invention provides that the variation in speed of rotation of the crank drive, determined mathematically from the kinematic parameters of the system, the masses moved and the external loads, be imparted to the drive motor as a desired course of the angular velocity. Therefore, the crank, driven by the motor, rotates in accordance with an angular velocity profile which corresponds to the natural variations inherent in the system under various circumstances.

The present invention also provides a method of imparting a compensated desired course of speed of rotation, wherein, for calculating the desired values of the speed of rotation, the reduced moment of mass inertia of the crank drive, the potential energy of the crank drive, and the load, converted to a reduced torque on the crank, are entered as a function of the crank angle into a computer, for example a high-speed computer, and, starting from the crank angular velocity in a given position of the crank, the angular velocities for the other crank angles are calculated, the result being processed to form the corresponding desired value of speed of rotation and being imparted to the motor of the drive device.

The method of the present invention also provides that the starting value of the crank angular velocity is determined iteratively from the starting position of the crank angle.

The present invention recognizes that optimal torque equalization can be obtained if the desired speed of rotation of the motor is not less than the actual instantaneous speed of rotation. Generator mode operation will be reliably avoided if the desired speed of rotation of the drive motor corresponds at all times to the speed of rotation to which it has just been accelerated or decelerated by the load. In order to assure this, it is necessary to determine the variation of the speed of rotation of the system which establishes itself. This can be accurately predicted in advance if the kinematic parameters, the masses moved and the external loads are known. The calculated variation in the speed of rotation which a friction-free crank drive would have in the state driven with constant torque is imparted to the drive motor as a desired course of the speed of rotation.

The present invention thus ensures that substantial accelerating or decelerating moments no longer need be supplied by the motor. In the steady-state operating region, the motor operates only against the frictional losses and the external loads, while the periodic variations of the mill itself are compensated. When there is no external load, the engine then operates only against the practically constant frictional losses and the motor moment is then approximately constant.

BRIEF DESCRIPTION OF THE DRAWINGS

The preferred embodiments are shown by way of example in the accompanying drawings in which.

DETAILED DESCRIPTION OF THE PREFERRED EMBODIMENTS

Figure 1:
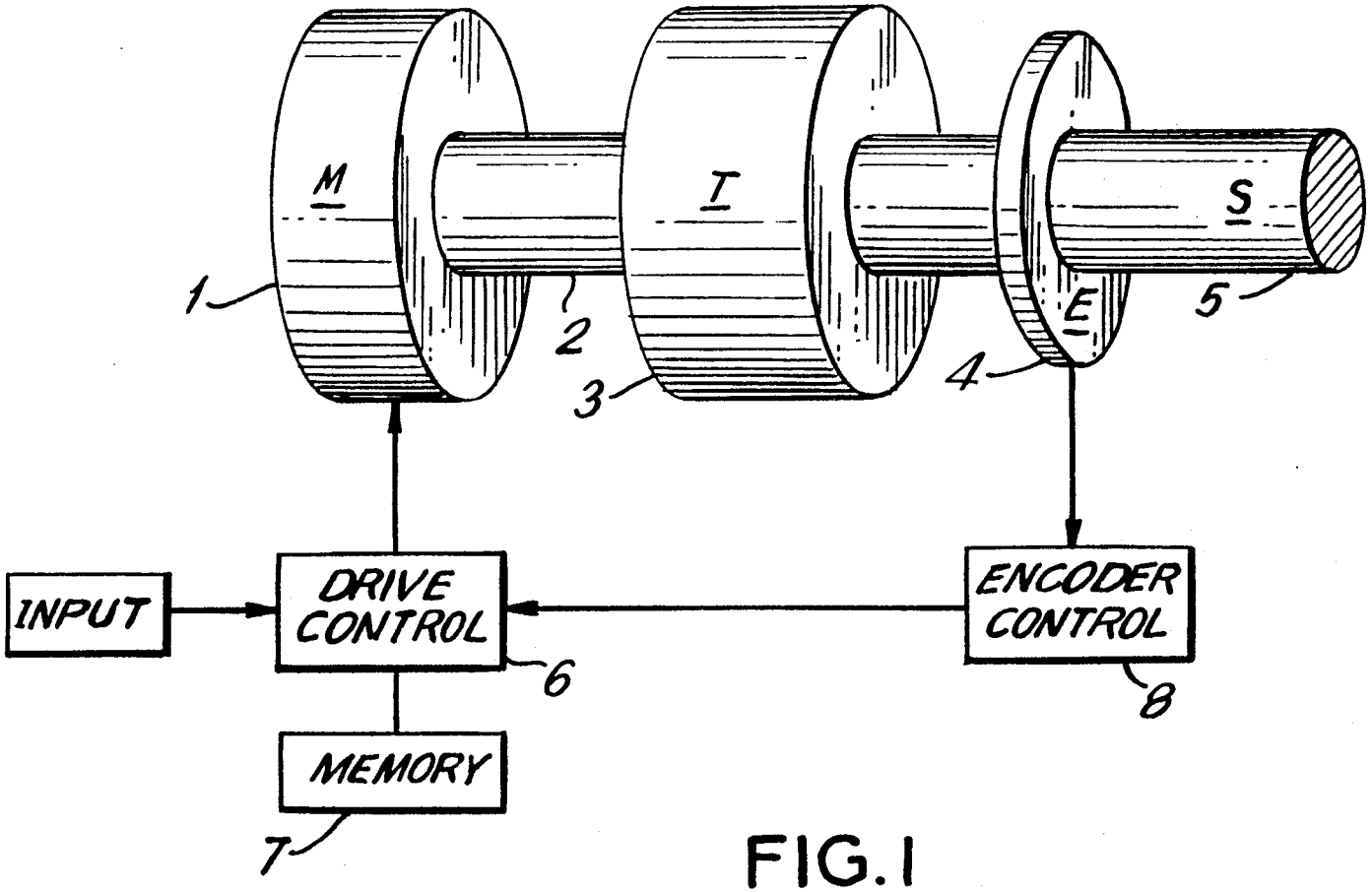
FIG. 1 is a schematic drawing of the drive apparatus of the present invention.

The system of the present invention is operated with a high-speed computer which precalculates the crank speed of rotation as a function of the instantaneous position of the crank and communicates it to the drive system. Systems of this kind which have the required speed of control and precision of control are known from the prior art. The computer may be of known type, and may form a part of the main control system of the mill. Since the control problem involves dynamic operation of a physical system, various systems, including digital, analog, hybrid, optical, etc. computers may be used. Further, the system may be adaptive. Because the system compensates for varying load, the control system preferably operates in real time, meaning that the computations necessary for correcting the transmission drive system are performed during the operation of the apparatus without a substantial lag; however, the system may advantageously use stored information relating to known parameters of the operation of the system in order to improve the control of the drive. In this sense, all of the computations necessary for the control are not computed simultaneously with the operation, as parameters of the operation are in that case extracted from prior experience. However, the present system is characterized in that based on the available data, the control is executed to perform the necessary compensation during the operation of the system, rather than based primarily on a predetermined course of action. This control is preferably executed by a high-speed computer.

In order to be able to calculate the speed of rotation, there are introduced into the computer, as function of the crank angle $\phi$:

a) the reduced mass moment of inertia $J_{red}$ of the crank drive, b) the potential energy $E_{pot}$ of the crank drive, and c) the load converted to the reduced torque $M_L$ on the crank.

Starting from the crank angular speed $\omega_o$ in position $\phi_o$ of the crank, the angular speeds of the crank for the other crank angles $\phi$ are determined by the following formula (I):

$$\omega(\phi) = \sqrt{\frac{2}{J_{red}\phi}\left[\Delta W(\phi) + E_{pot}(\phi_0) - E_{pot}(\phi) + \frac{1}{2} J_{red}(\phi_0)\omega_0^2\right.} \quad \text{(I)}$$

The excess work $\Delta W(\phi)$ is given by the formula (II):

$$\Delta W(\phi) = \int_0^{\phi} [M_{Mot,red} - M_L(\phi)]d\phi \quad \text{(II)}$$

in which the reduced motor moment is assumed constant according to formula (III):

$$M_{Mot,red} = \frac{1}{2\pi} = \int_0^{2\pi} M_L d\phi \quad \text{(III)}$$

feeds as much energy to the mechanical system crank drive during a period as is removed from it by the other external loads.

This reduced motor torque is merely a computational value; it is not to be confused with the actual torque of the motor. The actual motor torque will differ from the "reduced motor torque" by at least the portion necessary for overcoming frictional losses.

The starting value $\omega_o$, on which the precalculation of the variation of the angular speed $\omega(\phi)$ is based, must be determined iteratively. For this purpose, $\omega_o$ is changed until the condition given in formula (IV) is satisfied with sufficient precision:

$$\bar{n} = \frac{1}{T} = \frac{1}{\int_0^T dt} = \frac{1}{\int_0^{2\pi} \frac{d\phi}{\omega(\phi)}} \quad \text{(IV)}$$

wherein $\bar{n}$ is a predetermined average value of speed of rotation.

FIG. 1 shows a schematic diagram of an apparatus according to the present invention. The motor 1 drives a shaft 2, which drives an optionally present transmission, which is of known type. The output shaft 5 of the transmission has a position which is detected by a shaft position encoder 4. The shaft 5 drives the load of the system, which is a Pilger rolling mill.

The drive control 6 receives as inputs the output of the shaft encoder, which may, for instance, be processed to provide an absolute orientation, an angular velocity and an angular acceleration, by the encoder control 8. The encoder employed is known to those skilled in the art, and may be a mechanical, an optical, an opto-mechanical, a resolver-based, or other type of sensor. The associated sensor control may be, e.g., a microprocessor based control, or the functionality may be subsumed in another control system of the mill, such as the drive control. The drive control 6 also receives as inputs data relating to the kinematics of the system, which include the various velocities, masses, load parameters, as well as the desired angular velocity of the shaft. The drive control 6 is preferably a high-speed digital computer which operates on the data in real time to effect a high quality control system. Of course, the system may operate based on a model of the system which is periodically updated to reflect corrections in the system parameters. In such a case, the calculations need not be completed synchronously with the output of the angular position encoder, but rather need only update the real-time control system when calculated changes in parameters become available. the system may operate in an iterative manner in order for the drive control 6 to operate, therefore, a memory 7 device is included to store the results of previous calculations. Of course, a large number of data storage locations can be provided for storing various intermediate calculation results and input data, as well as various data for implementing a high order iterative control.

Figure 2:
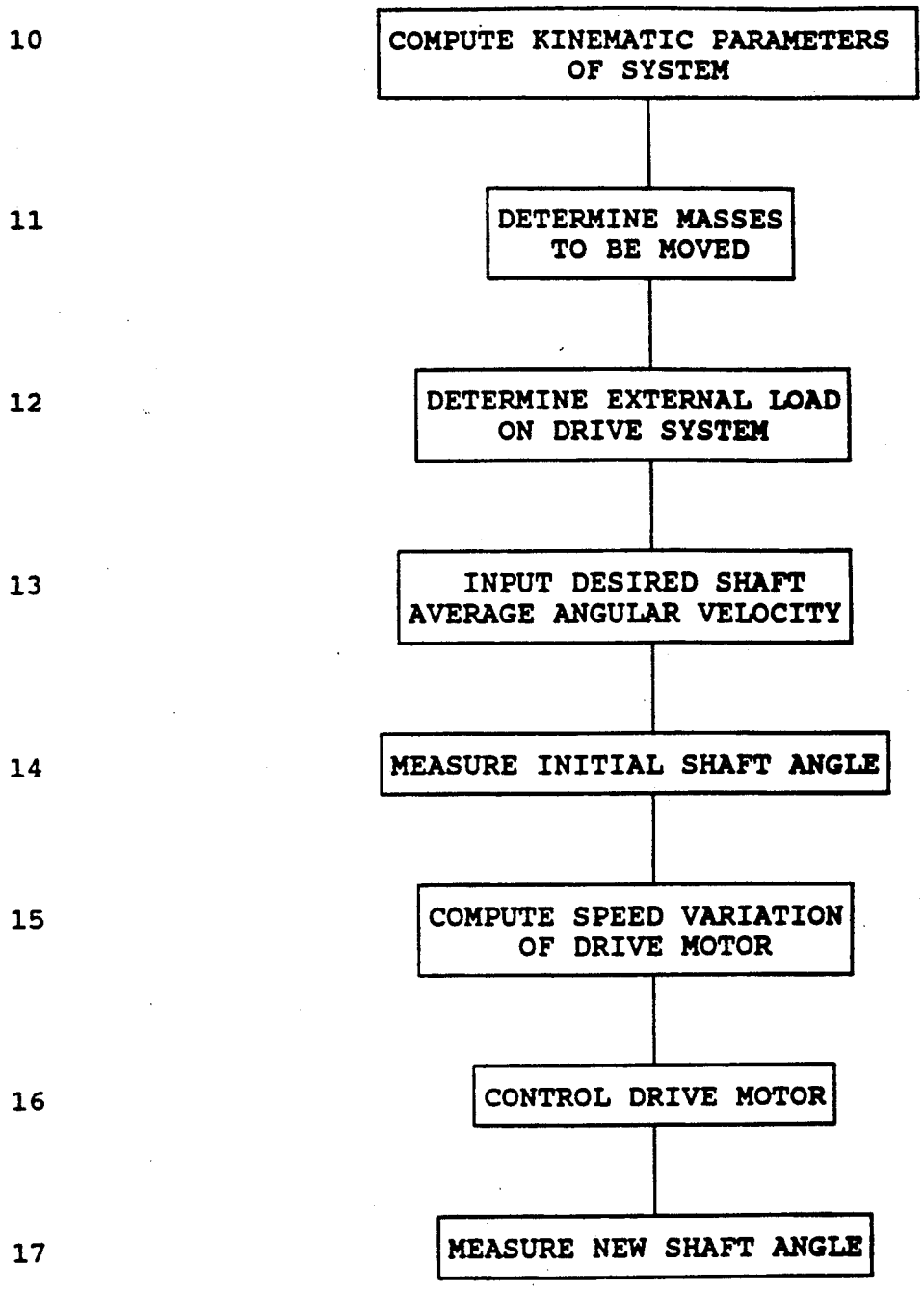
FIG. 2 is a flow diagram of a first method according to the present invention.

FIG. 2 shows, in flow diagram form, a first embodiment of a method according to the present invention. In particular, the method consists of the following steps. In a first step, the kinematic parameters of system are determined (10), which may be accomplished by direct input, computation from known parameters, or by a functional analysis of the system. The masses to be moved (11), as well as the external load (13) on drive system are determined by input of the data from an input device, or by calculation performed in the control. The desired shaft average angular velocity is also input (13) into the system, which may vary according to the nature of the work to be performed. The initial shaft angle is measured (14), and based on the shaft angle and the determined characteristics of the system as a whole, the speed variation of drive motor is computed (15), and appropriate signals are sent to the drive motor control (16). The system is then ready to calculate the next control signal for the drive system, and the new shaft angle is measured (17). An iterative control is thereby established, until interrupted by the operator or change in system parameters.

Figure 3:
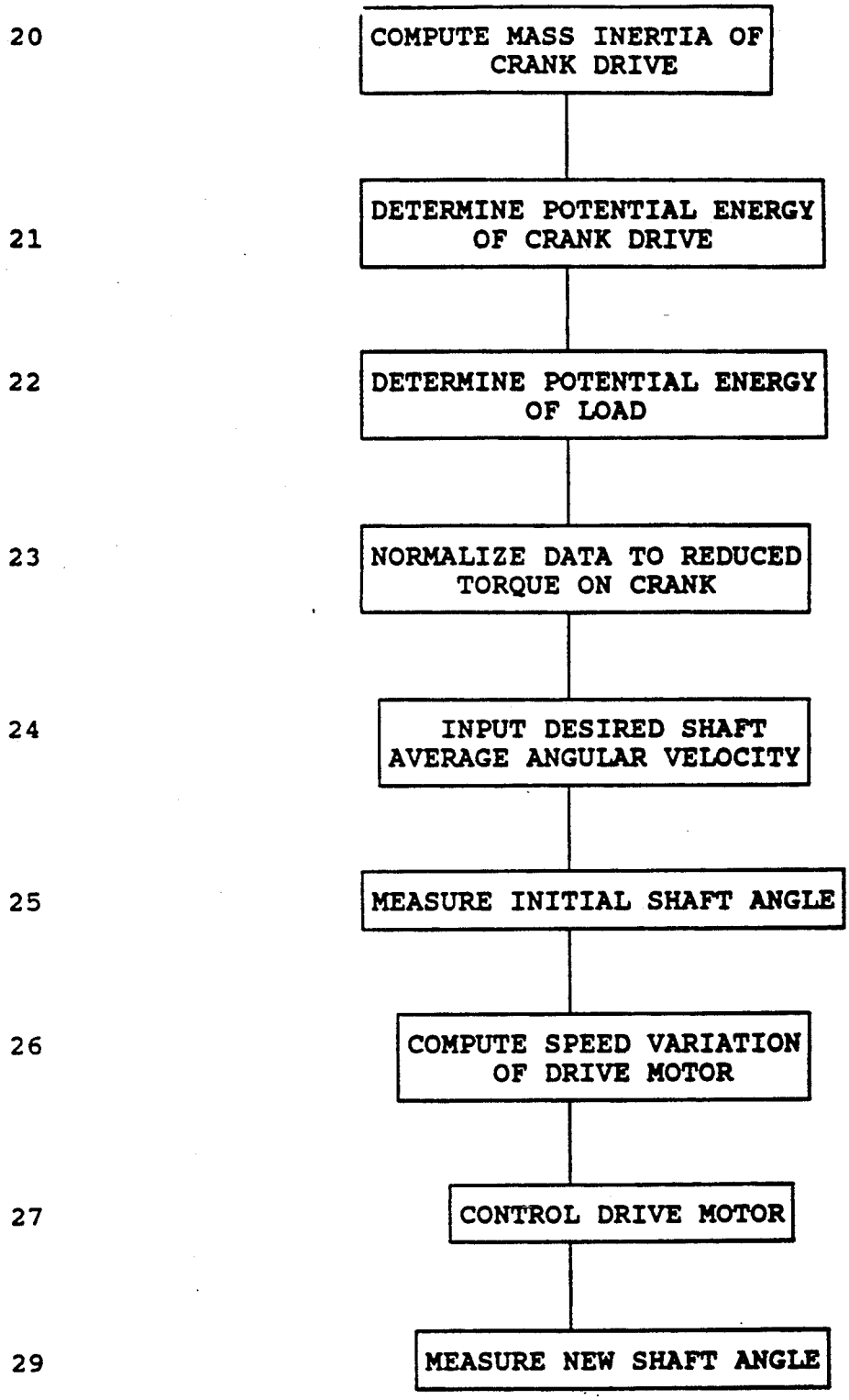
FIG. 3 is a flow diagram of a second method according to the present invention.

A second embodiment of the method according to the present invention is shown in the flow diagram of FIG. 3. According to this method, the mass inertia of the crank drive is initially computed (20), and the potential energy of the crank drive (21) and the load (22) are then determined. These data are normalized (23) to values reflecting a reduced torque valve on the crank. A desired shaft average angular velocity is input (24) from an external system, which may be a master mill control or a manual input. The initial shaft angle is measured (25), and the speed variation of drive motor is then computed (26). Based on this computed speed, the drive motor is controlled (27). The system then measures a new shaft angle (29) of the shaft, and the control is repeated.

It should be understood that the preferred embodiments and examples described are for illustrative purposes only and are not to be construed as limiting the scope of the present invention which is properly delineated only in the appended claims.

What is claimed is:

1. A method of equalizing the torque on a crank drive of a roll stand having a crank shaft operating under an external load, having reciprocating components moved linearly back and forth by the action of the crank drive of a Pilger rolling mill, the components having kinematic parameters and masses, comprising the steps of:

inputting a speed of mill operation;

mathematically calculating a variation in a speed of rotation of the crank drive from the input speed of operation, the kinematic parameters, the masses moved, and the external load; and outputting the calculated value as a desired course of the angular velocity of the crank drive.

2. The method according to claim 1, said method further comprises the step of measuring the crank shaft angle, said calculating step further comprising:

determining a crank shaft angular velocity;

calculating, as a function of the crank shaft angle, in a calculating device capable of processing the entered data without substantial delay, from; a) input information relating to a reduced moment of mass inertia of the crank drive, b) a potential energy of the crank drive, and c) a load converted to a reduced torque on the crank drive, a desired crank shaft angular velocity at other crank shaft angles, than the measured position of the crank shaft angle.

3. The method according to claim 1, further comprising the step of iteratively determining, from a starting angular position of the crank, shaft a starting value of the crank shaft angular velocity.

4. The method according to claim 1, wherein the crank drive angle is denoted by $\phi$, the reduced mass moment of inertia of the crank drive is denoted by $J_{red}$, the potential energy of the crank drive is denoted by $E_{pot}$, and the load converted to the reduced torque on the crank drive is denoted by $M_L$, starting from a crank drive angular speed $\omega_o$ in a position $\phi_o$ of the crank drive, an excess work $\Delta W(\phi)$ being determined by the formula (II):

$$\Delta W(\phi) = \int_0^{\phi} [M_{Mot,red} - M_L(\phi)]d\phi \qquad \text{(II)}$$

in which the reduced crank drive moment determined by formula (III) is assumed constant:

$$M_{Mot,red} = \frac{1}{2\pi} = \int_0^{2\pi} M_L d\phi \qquad \text{(III)}$$

said calculating step including the step of solving, for angular speeds of the crank shaft for the other crank angles $\phi$, by the following formula (I):

$$\omega(\phi) = \qquad \text{(I)}$$

-continued $$\sqrt{\frac{2}{J_{red}\phi}\left[\Delta W(\phi) + E_{pot}(\phi_0) - E_{pot}(\phi) + \frac{1}{2} J_{red}(\phi_0)\omega_0^2\right.}$$

5. The method according to claim 4, wherein said starting crank drive angular speed $\omega_o$, on which said solution of the variation of the angular speed $\omega(\phi)$ is based, is determined by iteratively solving the formula (IV):

$$\bar{n} = \frac{1}{T} = \frac{1}{\int_0^T dt} = \frac{1}{\int_0^{2\pi} \frac{d\phi}{\omega(\phi)}} \quad \text{(IV)}$$

wherein $\bar{n}$ is a predetermined average value of speed of rotation by changing $\omega_o$ until the formula (IV) is satisfied within a predetermined tolerance.

6. A Pilger rolling mill, comprising:

a roll stand operating under an external load, having reciprocating members moved back and forth by the action of a crank drive having a crank shaft, said members having kinematic parameters and masses, and having a minimum torque of operation;

an electrical drive motor, having an input and a torque and being rotationally connected to the crank shaft of the crank drive, said electrical motor driving the crank drive when said torque of said drive motor exceeds the minimum torque of operation, and braking said crank drive when said torque of said motor does not exceed the minimum torque of operation;

an angular position sensor for measuring an angular position of the crank drive;

calculating means receiving as an input a speed of mill operation, for mathematically calculating a variation in an angular velocity of the crank drive from the input speed of operation, the kinematic parameters, the masses moved, and the external load and producing a desired course of angular velocity of said drive motor so that said torque exceeds said minimum torque of operation; and means for controlling said drive motor according to said desired course of angular velocity, being connected to said input of said drive motor.

7. The apparatus according to claim 6, wherein said calculating means further comprises:

means for calculating a crank shaft angular velocity; and a calculating device, capable of processing the entered data without substantial delay, receiving as inputs information relating to a reduced moment of mass inertia of the crank drive, a potential energy of the crank drive, and a load converted to a reduced torque on the crank drive, as function of said angular position, and producing as an output a desired crank shaft angular velocity at crank angles other than said angular position, from said calculated crank shaft angular velocity at said angular position of the crank drive.

8. The apparatus according to claim 7, wherein said angular position of the crank drive is denoted by $\phi$, the reduced mass moment of inertia of the crank drive is denoted by $J_{red}$, the potential energy of the crank drive is denoted by $E_{pot}$, and the load converted to the reduced torque on the crank drive is denoted by $M_L$, starting from a crank drive angular velocity $\omega_o$ in an angular position $\phi_o$ of the crank drive, an excess work $\Delta W(\phi)$ being determined by the formula (II):

$$\Delta W(\phi) = \int_0^{\phi} [M_{Mot,red} - M_L(\phi)]d\phi \quad \text{(II)}$$

in which the reduced drive motor moment, determined by formula (III) is assumed constant:

$$M_{Mot,red} = \frac{1}{2\pi} = \int_0^{2\pi} M_L d\phi \quad \text{(III)}$$

said calculating device being for solving, for angular speeds of the crank drive for the other crank angular positions $\phi$, by the following formula (I):

$$\omega(\phi) = \sqrt{\frac{2}{J_{red}\phi}\left[\Delta W(\phi) + E_{pot}(\phi_0) - E_{pot}(\phi) + \frac{1}{2} J_{red}(\phi_0)\omega_0^2\right.} \quad \text{(I)}$$

9. The apparatus according to claim 8, wherein said calculating device calculates said starting crank drive angular speed $\omega_o$, on which said solution of the variation of the angular speed $\omega(\phi)$ is based, by iteratively solving the formula (IV):

$$\bar{n} = \frac{1}{T} = \frac{1}{\int_0^T dt} = \frac{1}{\int_0^{2\pi} \frac{d\phi}{\omega(\phi)}} \quad \text{(IV)}$$

wherein $\bar{n}$ is a predetermined average value of speed of rotation by changing $\omega_o$ until the formula (IV) is satisfied within a predetermined tolerance.

* * * * *